US011289853B2

(12) United States Patent
Stephens

(10) Patent No.: US 11,289,853 B2
(45) Date of Patent: Mar. 29, 2022

(54) CONDENSED OUTLET HAVING ALTERNATE PLUG IN CONFIGURATIONS WHICH SHARE A COMMON BUSS

(71) Applicant: John P (Jack) Methner, Bedford, TX (US)

(72) Inventor: Thomas G Stephens, Euless, TX (US)

(73) Assignee: John P. (Jack) Methner, Bedford, TX (US)

( * ) Notice: Subject to any disclaimer, the term of this patent is extended or adjusted under 35 U.S.C. 154(b) by 0 days.

(21) Appl. No.: 16/809,282

(22) Filed: Mar. 4, 2020

(65) Prior Publication Data

US 2020/0287329 A1 Sep. 10, 2020

Related U.S. Application Data

(60) Provisional application No. 62/815,894, filed on Mar. 8, 2019.

(51) Int. Cl.

| | |
|---|---|
| ***H01R 13/642*** | (2006.01) |
| ***H01R 43/26*** | (2006.01) |
| ***H01R 13/11*** | (2006.01) |
| ***H01R 13/518*** | (2006.01) |
| ***H01R 25/00*** | (2006.01) |

(52) U.S. Cl.

CPC ..... *H01R 13/642* (2013.01); *H01R 13/11* (2013.01); *H01R 13/518* (2013.01); *H01R 25/006* (2013.01); *H01R 43/26* (2013.01)

(58) Field of Classification Search

CPC .... H01R 13/11; H01R 13/518; H01R 13/642; H01R 13/652; H01R 13/35; H01R 25/006; H01R 43/26; H01R 24/30

See application file for complete search history.

(56) References Cited

U.S. PATENT DOCUMENTS

| | | | | |
|---|---|---|---|---|
| 8,439,692 | B1 * | 5/2013 | Oddsen | H01R 25/006 439/107 |
| 9,437,993 | B2 | 9/2016 | Stephens | |
| D875,049 | S | 2/2020 | Stephens | |

OTHER PUBLICATIONS

"TopGreener USB Outlet", Oct. 23, 2017, retrieved from Amazon.com, https://www.amazon.com/dp/B076PKVPHQ?ref=dacx_dp_3584541310301_9426620620601&aaxitk=NI7RX35mOHEbvsYSrm82oQ.

"Three Outlet Power Panel", Aug. 29, 2008, retrieved from gadgets.boingboing.net, https://gadgets.boingboing.net/2008/08/29/three-outlet-power-p.html.

"Maxxima Dual USB Charger Wall Outlet", Apr. 6, 2018, retrieved from overstock.com https://www.overstock.com/Home-Garden/Maxxima-Dual-USB-3.1A-Charger-Wall-Outlet-with-15-Amp-Duplex-Receptacle-Horizontal-Ports-White/16079027/product.html.

"Topgreener USB Charger Outlet", Jan. 31, 2018, retrieved from amazon.com https://www.amazon.com/dp/B079H4GGP7/ref=sspa_dk_detail_3.

* cited by examiner

*Primary Examiner* — Vanessa Girardi
(74) *Attorney, Agent, or Firm* — Timothy G. Ackermann

(57) ABSTRACT

A device for imparting electrical energy to one or more male plugs, the device including female receiving ports for receiving the blades from one or more male plugs side by side such that the female receiving port capable of receiving a hot blade from the male plug is screened on both sides by female receiving ports capable of receiving a neutral blade from the male plug, and the device including female receiving ports for receiving the blades from an earth pin, the ports extending outwardly beyond the edge of the faceplate and to a portion of a grounded mounting bracket.

17 Claims, 6 Drawing Sheets

CONDENSED OUTLET HAVING ALTERNATE PLUG IN CONFIGURATIONS WHICH SHARE A COMMON BUSS

BACKGROUND OF THE INVENTION

Electrical sockets are required to accept grounded plugs and plugs with polarized blades to prevent the blades from being inserted in the socket in the incorrect orientation. Such sockets force a particular orientation which can create physical interference between plugged-in devices or reduce the number or types that may be plugged into the socket. In addition, USB ports are desirable to include in a socket. But sockets are commonly limited in size and shape by customer desires or existing infrastructure. Further, a reversible-type socket, to accept a plug in opposing orientations may include a port for a hot blade that remains uncovered in either orientation, potentially exposing the hot buss to entry of items creating risk of short or fire.

SUMMARY OF THE INVENTION

In an embodiment of the invention, a condensed outlet comprises at least one set of three female receiving ports, substantially side-by-side, for receiving blades from one or more male plugs, one hot and two neutral, and, optionally, two female receiving ports for receiving earth pins one or more male plugs. Each of the female receiving ports capable of receiving a neutral blade from the male plug in a set is outward of the female receiving port capable of receiving a hot blade from the male plug.

In an embodiment of the invention, the set of at least three female receiving ports permits a plug to be received in two opposing orientations. For example, the device can receive a plug in one orientation, with its neutral blade in one of the two outboard neutral-receiving ports, and can also receive the plug in the opposing orientation (with the plug rotated 180 degrees about an axis parallel to the blades) with its neutral blade in the other of the two outboard neutral-receiving ports. Thus, both the first and second, and the second and third, of the three female receiving ports in a set can receive a plug, albeit not simultaneously.

In an embodiment of the invention, a condensed outlet includes the set of at least three female receiving ports positioned within the device as described above and as well as grounding female receiving ports positioned within the outlet. One grounding female receiving port is positioned in a triangular configuration with the first female receiving port and the second female (hot) receiving port of a set such that that set can receive a U-shaped pin in a first grounding female receiving port on one side of a line formed by the side-by-side three female receiving ports. And another grounding female receiving port is positioned in a triangular configuration with the second female (hot) receiving port and the third female receiving port of a set such that that set can receive a U-shaped pin in a second grounding female receiving port on the other side of a line formed by the side-by-side three female receiving ports. Here again, the device can receive a plug in one orientation, with its neutral blade in one of the two outboard neutral-receiving ports and receive a grounding pin, and can also receive the plug in the opposing orientation (with the plug rotated 180 degrees about an axis parallel to the blades) with its neutral blade in the other of the two outboard neutral-receiving ports and also receive a grounding pin.

In an embodiment of the invention, a condensed outlet includes the set of neutral and hot female receiving ports positioned within the device, and the grounding pin female receiving ports as described above as well as one or more universal serial bus (USB) ports positioned within the device for connecting electronic devices having a USB connectivity port to the USB port of the device.

In an embodiment of the invention, a condensed outlet includes at least two sets of three neutral and hot female receiving ports with grounding pins permitting each set to receive a grounded plug in two opposing orientations, and a set of USB ports oriented between each of the sets.

In an embodiment of the invention, a condensed outlet includes at least two sets of three neutral and hot female receiving ports with grounding pin receiving ports permitting each set to receive a grounded plug in two opposing orientations, and a set of USB ports oriented between each of the sets, where one or more of the grounding pin receiving ports extends outwardly beyond the edge of a faceplate on the outlet.

In an embodiment of the invention, a condensed outlet includes at least two sets of three neutral and hot female receiving ports with grounding pin receiving ports permitting each set to receive a grounded plug in two opposing orientations, and a set of USB ports oriented between each of the sets, where one or more of the grounding pin receiving ports includes a grounding contact formed by one of the outlet mounting brackets.

In an embodiment of the invention, a condensed outlet includes one or more grounding pin receiving ports open to an outer surface of the outlet with a grounding contact formed an outlet mounting bracket.

In an embodiment of the invention, a condensed outlet includes at least two sets of three side-by-side female receiving ports (two neutral and one hot therebetween) each set with grounding pin receiving ports permitting each set to receive a grounded plug in two opposing orientations, and with three busses electrically isolated from one another. In an embodiment, the hot buss provides access to the energized wire to just two hot blade receiving ports via an internal metal conductive path. That path may extend in opposing directions from an energized supply wire contact structure. In an embodiment, the neutral buss provides access to the neutral wire to four neutral blade receiving ports on opposing sides of said hot blade receiving ports via an internal metal conductive path. That path may also extend in opposing directions from an energized supply wire contact structure. And in an embodiment, the ground buss provides access to ground for four ground receiving ports via an internal metal conductive path. That path may extend from one, or between two, ground wire contact structures. In an embodiment, outlet mounting brackets forming grounding contacts for grounding pins are formed on the grounding buss between the ground wire contact structures. In an embodiment, outlet mounting brackets forming grounding contacts for grounding pins are formed on the grounding buss on the path outward of the ground wire contact structures.

In some installations of outlets, the outlet may be installed in a sideways orientation, such that the line established by the side-by-side female ports is oriented vertically. In this instance, the upper-most port will necessarily be one of the two outboard ports and thus a neutral port (i.e. one connected to a neutral wire, and not one connected directly to an energized wire). This is an advantage, in particular should such installations be in kitchens or other areas in which liquids or substance including liquids may spill, spatter, or be thrown on an outlet on a wall, as the liquid could drip downwards into the port. Due to gravity, drips are most likely to enter the uppermost port. Liquid entering a neutral port is less dangerous than it entering a hot port which carries an increased risk of dangerous short circuits. Outboard neutral ports thus shield the hot ports when installed in a sideways configuration.

Further embodiments include: An outlet for supplying electric power to one or more plugs, comprising a grounding buss comprising at least one mounting bracket, and an exterior outlet body, and at least one exterior ground pin receiver comprising a ground pin contact formed on the mounting bracket. An outlet, for use in an environment having plugs with ground pins, further comprising an exterior outlet body, the exterior ground pin receiver comprising an open slot formed in said body such that it will expose a fully-inserted ground pin to the exterior. An outlet, further comprising two opposing mounting brackets, said grounding buss comprising at least two of said exterior ground pin receivers, each comprising a ground pin contact formed on opposing mounting brackets, and at least two interior ground pin receivers. An outlet, further comprising a hot buss and a neutral buss, said hot buss comprising at two hot blade receivers, and said neutral buss comprising at least four neutral blade receivers, and comprising at least two reversible plug port groups, wherein a reversible plug port group comprises two of said neutral blade receivers on opposing sides of a hot blade receiver, an interior ground pin receiver, and one of said exterior ground pin receivers. And an outlet, further comprising at least two reversible plug port groups, each comprising at least one of said exterior ground pin receivers, a hot receiver, a set of two neutral receivers, one each spaced apart to each side of the hot receiver, and a second ground pin receiver located on an opposing side of the neutral receivers from said exterior receiver, and further a set of USB ports located between the at least two plug port groups.

Multiple types of plugs exist in the United States, including type "A" and type "B" plugs. National standards for plugs set out that a type A is a class II ungrounded plug with two flat parallel prongs and is known as National Electrical Manufacturers Association (NEMA) 1-15. It has two flat 1.5 mm thick blades, measuring 15.9 to 18.3 mm in length and spaced 12.7 mm apart. It is generally polarized and can only be inserted in a socket one way because the two blades do not have the same width. The blade connected to the neutral is 7.9 mm wide and the hot blade is 6.3 mm wide. The socket for type A is constructed to accept the design of this type of plug. Type B is a class I grounded plug and designated as American standard NEMA 5-15. It has two flat 1.5 mm thick blades, spaced 12.7 mm apart, measuring 15.9 to 18.3 mm in length and 6.3 mm in width. It also has a 4.8 mm diameter round or U-shaped earth pin, which is 3.2 mm longer than the two flat blades, for grounding purposes, located offset in a triangular configuration from the blades by 6.35 mm edge-to-edge or 11.91 mm center-to-center. The socket for type B is constructed to accept the design of this type of plug, often including the socket clockwise from the earth pin being taller to accept the taller neutral blade of a polarized B plug. A device may mean, without limitation, a socket, electrical socket, duplex socket, multiplex socket, receptacle, outlet, electrical outlet, power strip, adaptor or any other device which permits one or more plugs to be connect/received thereto for the reception of electrical energy.

This application expressly incorporates by reference the entire disclosure of U.S. Ser. No. 62,815,894.

DETAILED DESCRIPTION

Figure 1:
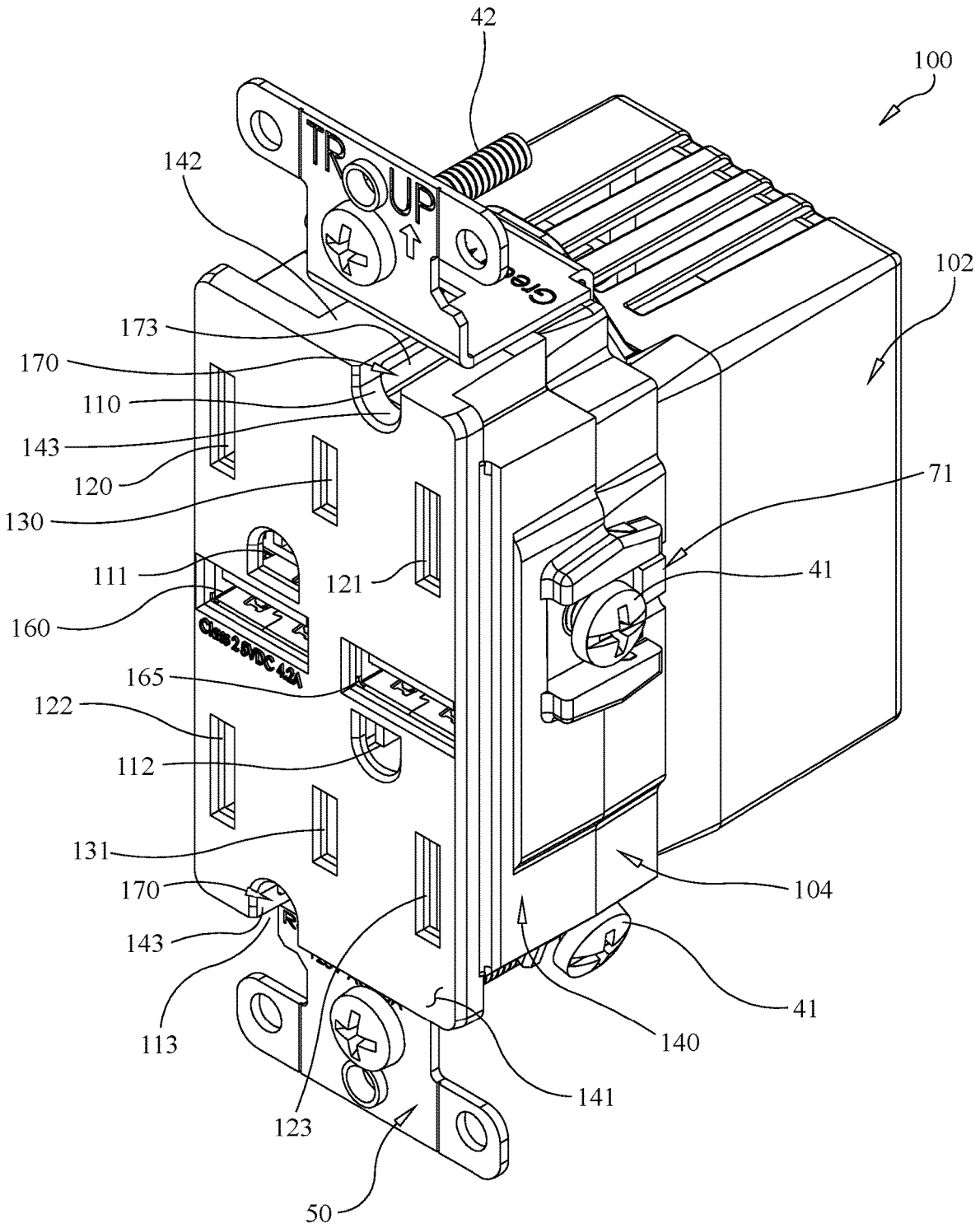
FIG. 1 shows a perspective view of the present invention.
Figure 2B:
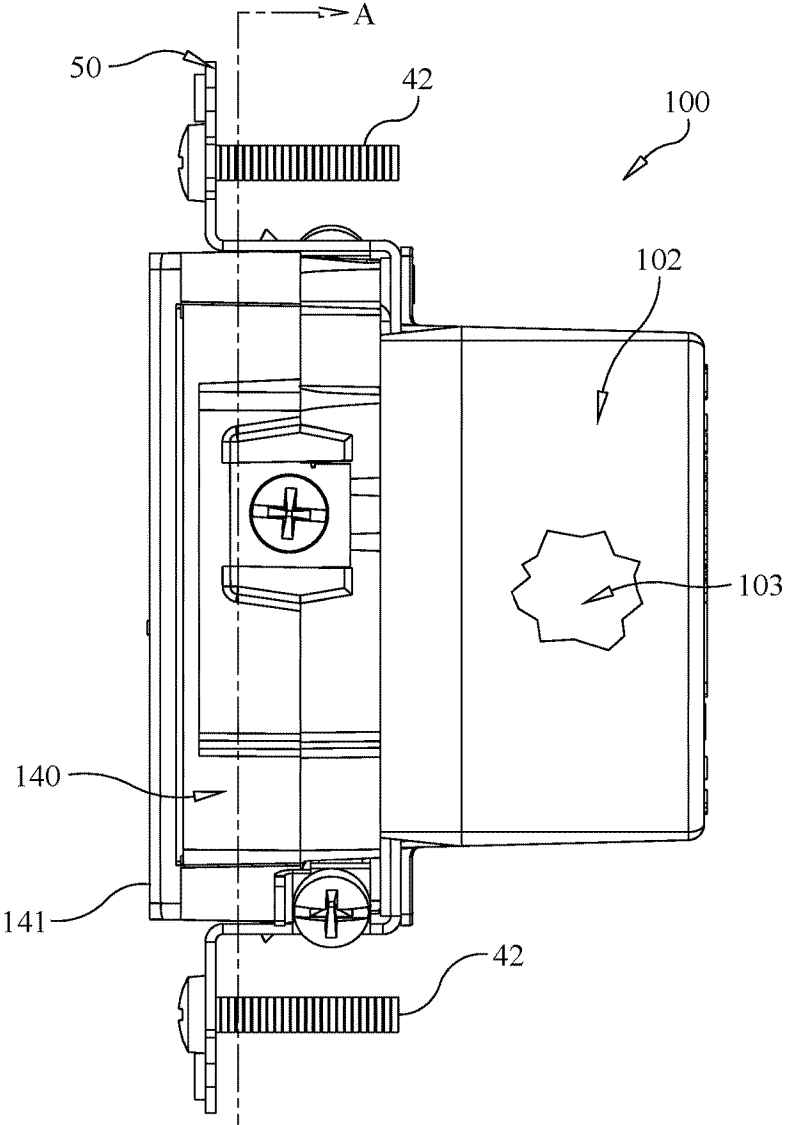
FIG. 2B shows a partial cutaway side view of the present invention.
Figure 2A:
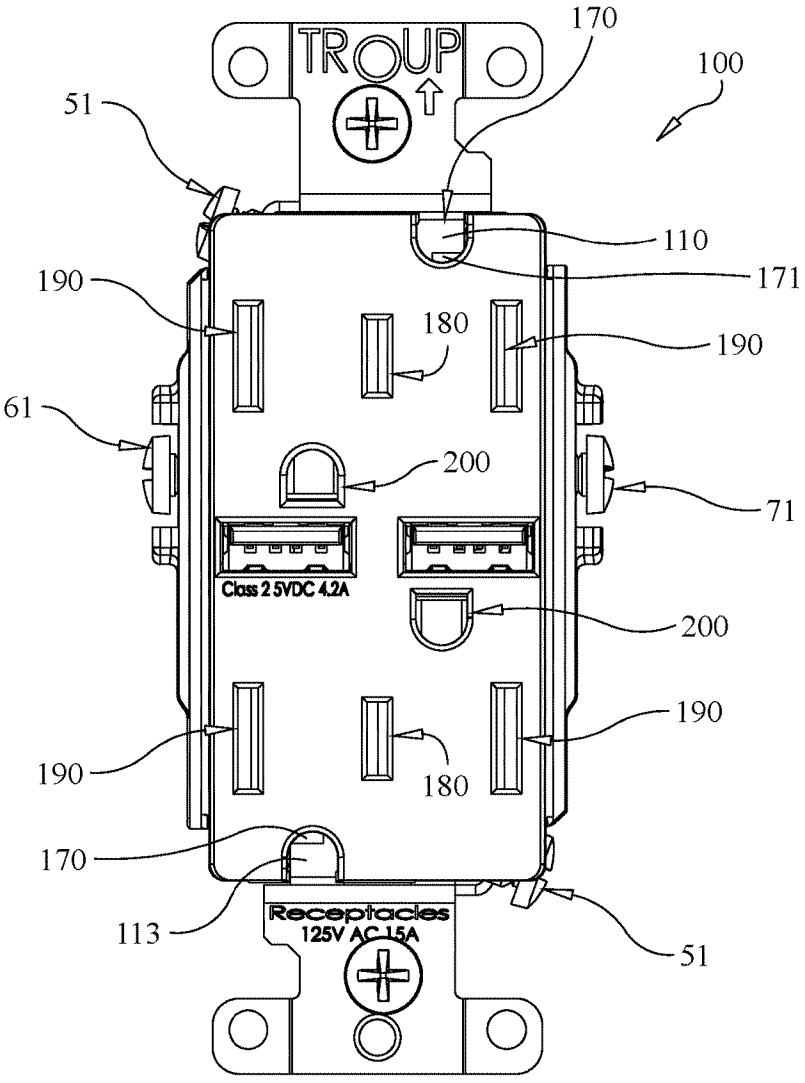
FIG. 2A shows a front view of the present invention.

Turning to FIGS. 1, 2A & 2B, an electrical socket 100 includes a front casing 140, rear casing 104, rear enclosure 102, and electronics 103. Front casing 140 includes faceplate 141 with access holes formed therethrough for entry of male plug blades and pins to corresponding receiving ports therebehind. Extending from rear casing 104, on either short end of socket 100, are mounting brackets 54 of ground buss 50 (see FIG. 4), including mounting screws 42, for mounting outlet 100 in a building (not shown). Socket 100 comprises two sets of three female receiving ports each for receiving the blades from one or more male plugs. Top ports, neutral port 190, hot port 180, and neutral port 190, are accessed by top access holes 120, 130, 121 respectively, and bottom ports, neutral port 190, hot port 180, and neutral port 190, are accessed by bottom access holes 122, 131, 123 respectively. Ports 190, 180, and 180, are each positioned within socket 100 side by side spaced from the other ports within each set such that port 190 can receive a neutral blade while adjacent (center) port 180 receives a hot blade, and such that the next adjacent port 190—opposite of the other port 190, also can receive a neutral blade while adjacent (center) port 180 receives a hot blade.

Socket 100 further comprises ports for receiving earth pins for grounding purposes. Each of the two sets of three female receiving ports for blades is joined by grounding female receiving ports 170 and 200. On the top set, grounding port 200, associated with access slot 111, is positioned laterally between and below ports 190 and 180 associated with access holes 120 and 130 (on the left), and grounding port 170, associated with access hole 110, is positioned laterally between and above ports 180 and 190 associated with access holes 130 and 121 (on the right). On the bottom set, the arrangement of grounding ports is reversed, such that grounding port 170, associated with access hole 113, is positioned laterally between and below ports 190 and 180 (clockwise of the hot port) associated with access holes 122 and 131 (on the left), and grounding port 200, associated with access slot 112, is positioned laterally between and above ports 180 and 190 (clockwise of the hot port) associated with access holes 131 and 123 (on the right). Thus, both the top port group and the bottom port group can receive U-shaped earth pin at its upper extremity and its lower extremity, permitting an inserted plug to be inserted in opposing 180-degree reversed orientations.

Ground access slots 110, 113 each include notch 143 in the outward-facing faceplate 141, along its upper and lower sides, and rearward-extending gap 173 in upper & lower extensions 142 of front casing 140. Notches 143 and gaps 173 accept earth pins and leave portions of such pins, when fully inserted, exposed on the exterior of outlet 100.

USB ports 160 and 165 are positioned in socket 100 side-by-side between the upper and lower port groups, such that they are below ground access hole 111 and above ground access hole 112. Additional USB ports may be included as space permits.

Socket 100 also comprises hot wire connection 71, neutral wire connection 61, and ground wire connections 51. Each connection 51, 61, 71 includes wire screw 41 for clamping the respective hot wire, neutral wire, and/or one or more ground wires (not shown) to the respective connection.

Figure 3:
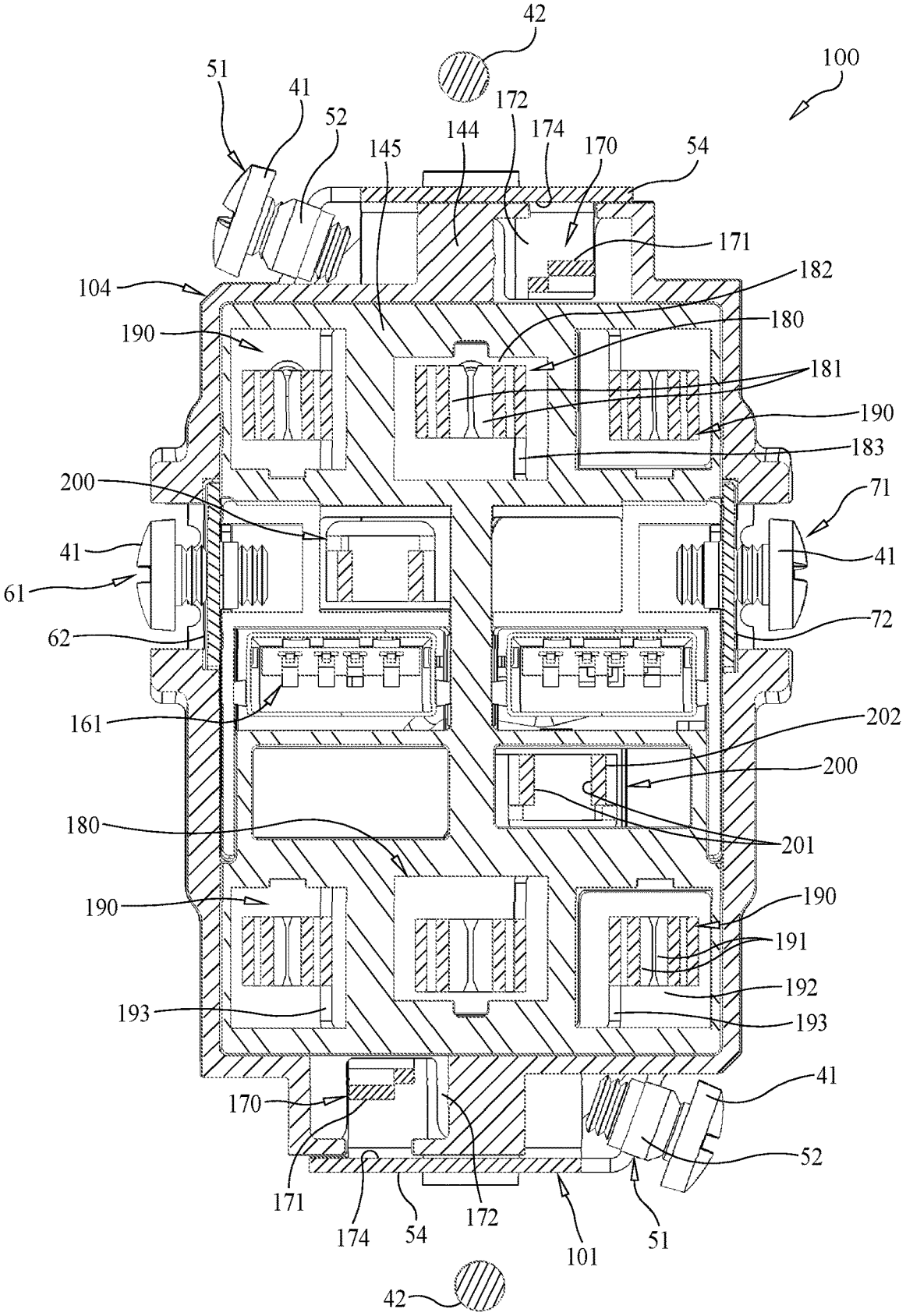
FIG. 3 shows a section view of the present invention along section line A-A in FIG. 2B.

FIG. 3 shows section A-A through front casing 104 (from FIG. 2B) and reveals interior structures of socket 100. Female receiving ports 180 include opposing, springing, blade contacts 181 in enclosed spaces 182. Female receiving ports 190 include opposing, springing, blade contacts 191 in enclosed spaces 192. USB plug structure 161 is shown corresponding to ports 160, 165 (FIG. 1). Ground ports 200 include opposing, springing, pin contacts 201 in spaces 202. Ground ports 170 each include springing pin contact 171 and opposing pin contact surface 174 on mounting brackets 54, located in top and bottom open slots 172. Spaces 182, 192, and 202, and space for plug structures 161, are defined in body 145. Open slots 172 are defined in/by exterior outlet body 144 and body 145 and brackets 54. Also depicted are hot wire connection 71, neutral wire connection 61, and ground wire connections 51, each including, respectively a connection tab 72, 62, and 52. Wire screw 41 clamping the respective hot wire, neutral wire, and/or one or more ground wires (not shown) to the respective connection tabs tab 72, 62, and 52 to create an electrical connection.

Figure 4:
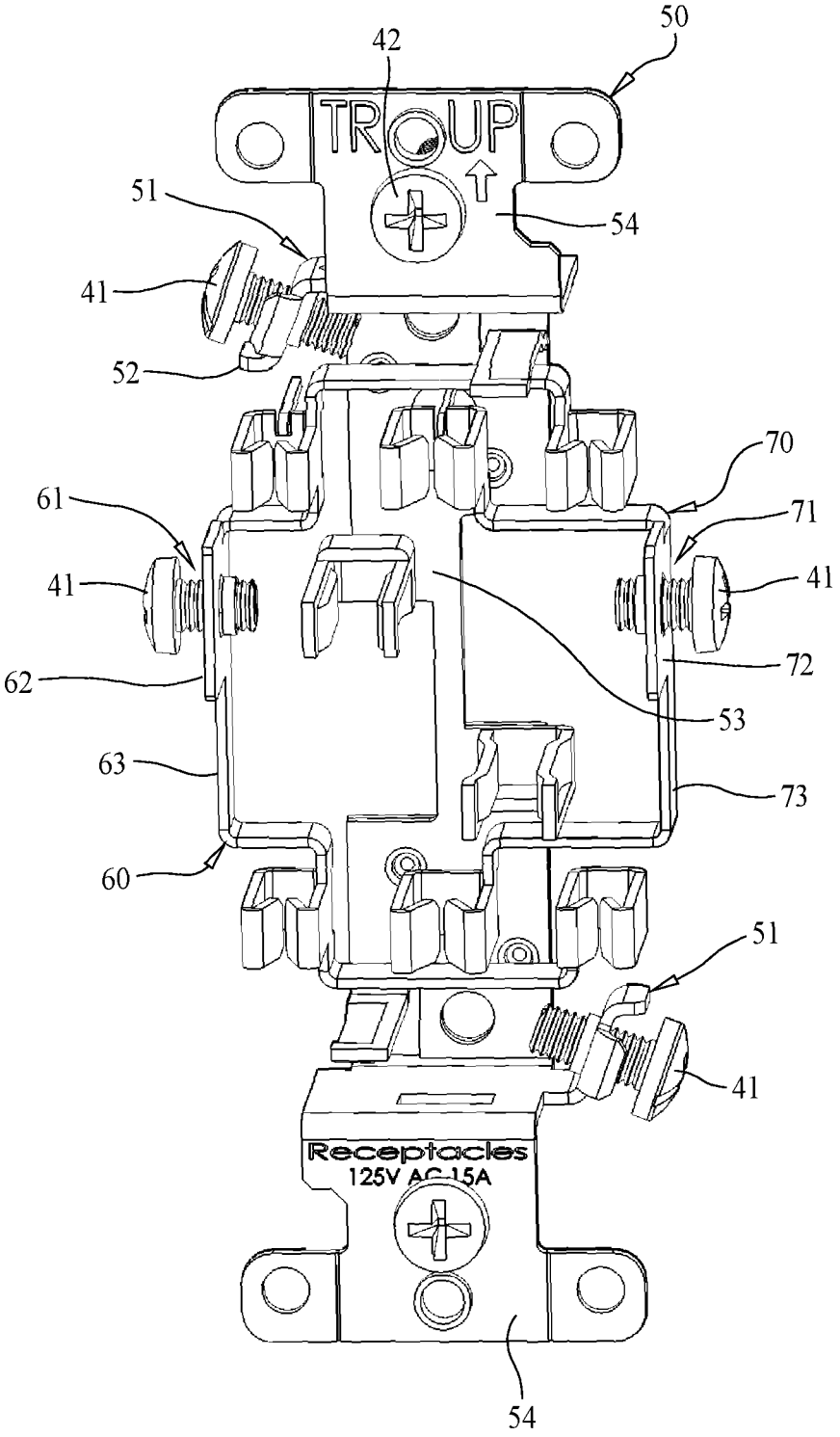
FIG. 4 shows an oblique front view of a part in the present invention.
Figure 5B:
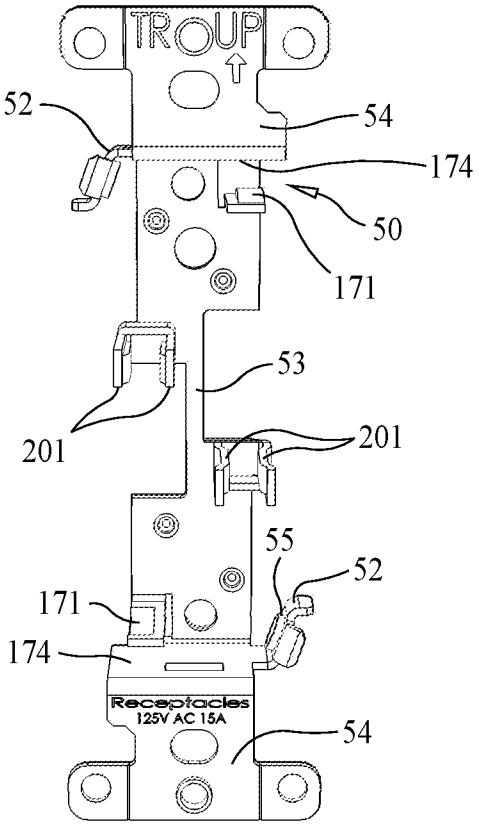
FIGS. 5A & 5B show oblique front views of an isolated ground buss and of a neutral and hot buss together, respectively, in the present invention.
Figure 5A:
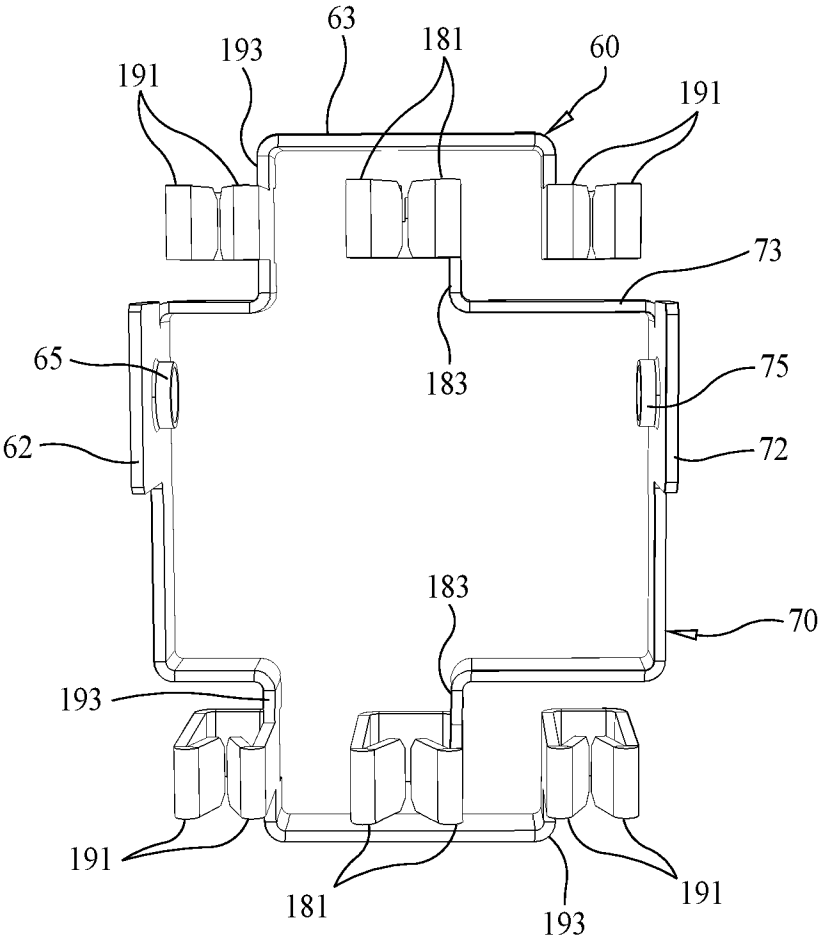

FIG. 4 shows a set of components of an embodiment of the present invention, and FIGS. 5A & 5B show the parts in FIG. 4 partially isolated from one another (less screws 41, 42). In particular, these figures show the 120V buss structures for the hot (energized) side, the neutral side, and the ground side, including busses, extensions, wire connections, and blade and pin contacts.

Ground buss 50 comprises, at each end, mounting brackets 54 for mounting in a building (not shown) using screws 42. Brackets 54 each have a vertically-oriented face aligned with faceplate 141, and a pin contact surface 174, oriented substantially normal thereto, extending rearwardly to vertical backplate 53. Backplate 53 and brackets 54 are conductive metal structures designed to carry expected current flows, retain their configuration, and support the components fixed thereto. Connection tabs 52 extend to the side from each of brackets 54, and permit advancement of screws 42 in threads 55. Inward from each of pin contact surfaces 174, and extending forwardly substantially parallel thereto from back plate 53, are springing pin contacts 171. Further inwardly, extending forwardly from backplate 52, are two sets of opposing, springing, pin contacts 201, offset side-to-side from one another across the centerline of ground buss 50. In this embodiment, ground buss 50 forms a substantially linear set of connections (52-171/174-201-201-171/174-52) but other configurations are possible (e.g. 171/174-52-201-201-52-171/174, or branching structures such as 171/174-201-& 52-201-to 201-201, to-201-52, & -201-171/174).

Neutral buss 60 comprises connection tab 62, to one side (in this embodiment, the left), which permits advancement of screw 42 in thread 65. Buss bar 63 extends both upwardly and downwardly from tab 62 to opposing corners of socket 100, to support two top sets of blade contacts 191, supported by extensions 193, and two bottom sets of blade contacts 191, supported by extensions 193. Buss bar 63 is a conductive metal structure designed to carry expected current flows, retain its configuration, and support the components fixed thereto. In this embodiment, neutral buss 60 forms a substantially linear set of connections (191-191-62-191-191) but other configurations are possible (e.g. 62-191-191-191-191 or branching structures such as 191- & 191-, to 62, to -191 & -191).

Hot buss 70 comprises connection tab 72, to one side (in this embodiment, the right), which permits advancement of screw 42 in thread 75. Buss bar 73 extends both upwardly and downwardly from tab 72 to top & bottom centers of socket 100, to support a top set of blade contacts 181, supported by extensions 183, and a bottom set of blade contacts 181, supported by extensions 183. Buss bar 73 is a conductive metal structure designed to carry expected current flows, retain its configuration, and support the components fixed thereto. In this embodiment, hot buss 70 forms a substantially linear set of connections (181-72-181) but other configurations are possible (e.g. 72-181-181).

Figure 6B:
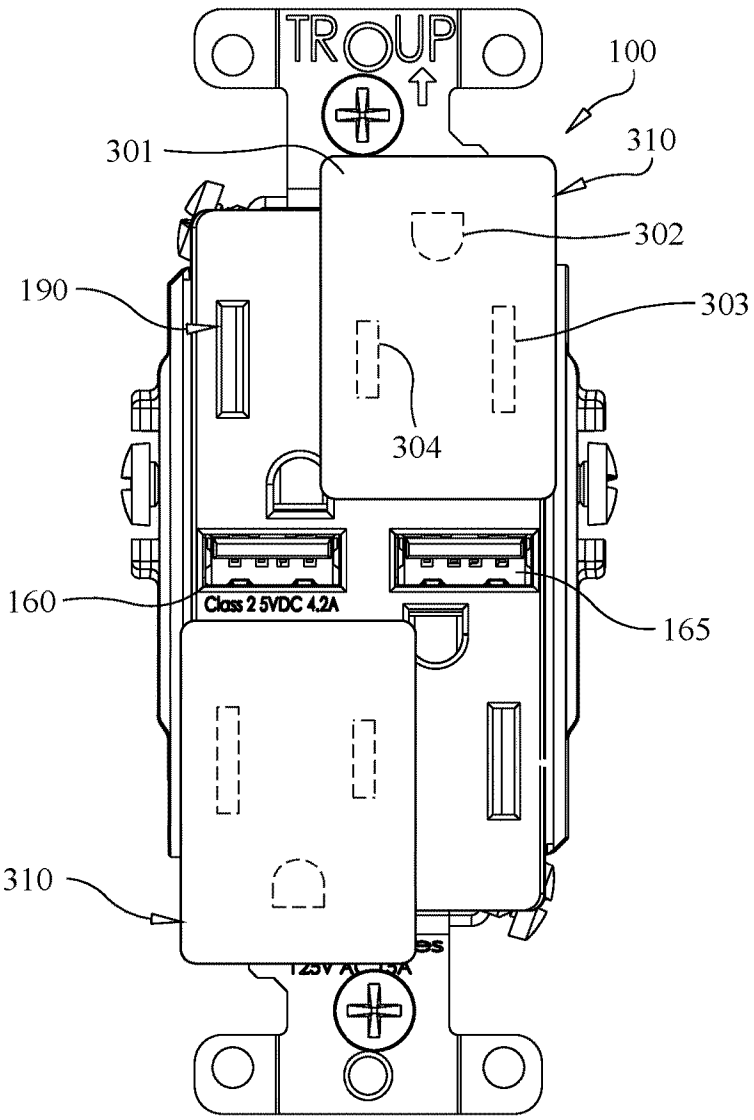
FIGS. 6A-6B show front views of the present invention with plugs inserted therein.
Figure 6A:
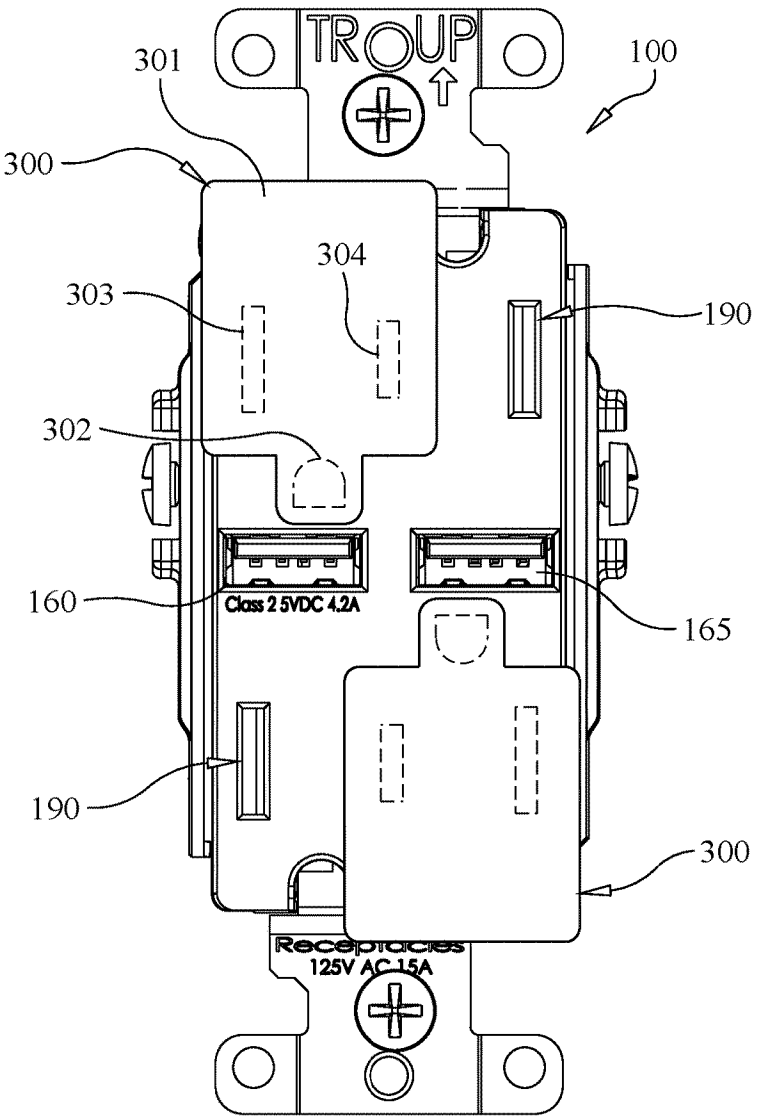

Turning to FIGS. 6A & 6B, socket 100 is shown with plugs 300 or 310 plugged thereinto. In FIG. 6A, plug 300 includes body 301, grounding pin 302, neutral blade 303, and hot blade 304. In this configuration, for the top plug 300, grounding pin 302 is inserted into grounding port 200 via access slot 111, neutral blade 303 is inserted into neutral port 190 via access hole 120, and hot blade 304 is inserted into hot port 180 via access hole 130, but leaving only a neutral port 190 exposed. In this configuration, for the bottom plug 300, grounding pin 302 is inserted into grounding port 200 via access slot 112, neutral blade 303 is inserted into neutral port 190 via access hole 123, and hot blade 304 is inserted into hot port 180 via access hole 131, but leaving only a neutral port 190 exposed. Body 301 of plug 300 extends away from neutral blade 303 and hot blade 304 such that two plugs 300 could not be installed in the reverse configuration (using grounding ports 170) due to physical interference between the bodies 301.

In FIG. 6B, plug 310 includes body 301, grounding pin 302, neutral blade 303, and hot blade 304. In this configuration, for the top plug 310, grounding pin 302 is inserted into grounding port 170 via access slot 110, neutral blade 303 is inserted into neutral port 190 via access hole 121, and hot blade 304 is inserted into hot port 180 via access hole 130, but leaving only a neutral port 190 exposed. In this configuration, for the bottom plug 310, grounding pin 302 is inserted into grounding port 170 via access slot 113, neutral blade 303 is inserted into neutral port 190 via access hole 122, and hot blade 304 is inserted into hot port 180 via access hole 131, but leaving only a neutral port 190 exposed. Body 301 of plug 310 extends away from grounding pin 302 such that two plugs 310 could not be installed in the reverse configuration (using grounding ports 200) due to physical interference between the bodies 301.

The invention claimed is:

1. An outlet for supplying electric power to one or more plugs, comprising:

a grounding buss;

said grounding buss comprising at least one mounting bracket; and at least one exterior ground pin receiving port;

said at least one exterior ground pin receiving port comprising a ground pin contact;

said ground pin contact formed on the mounting bracket;

said grounding buss further comprising a second mounting bracket;

two interior ground pin receiving ports; and a second exterior ground pin receiving port;

said second exterior ground pin receiving port comprising a second ground pin contact;

said second ground pin contact formed on the second mounting bracket;

two hot blade receiving ports;

four neutral blade receiving ports;

a hot buss;

said hot buss electrically connected to said hot blade receiving ports; and a neutral buss; and said neutral buss electrically connected to said neutral blade receiving ports; and comprising at least two reversible plug port groups;

each reversible plug port group comprising two of said neutral blade receiving ports on opposing sides of one of said hot blade receiving ports, one of said interior ground pin receiving ports, and one of said exterior ground pin receiving ports.

2. The outlet of claim 1, with plugs with ground pins for insertion into said exterior ground pin receiving port, further comprising:

an exterior outlet body having an exterior thereof; and the at least one exterior ground pin receiving port further comprising an open slot formed in said exterior outlet body and defined by said mounting bracket;

wherein such open slot exposes an inserted ground pin to the exterior of the exterior outlet body.

3. An outlet for supplying electric power to one or more plugs, comprising:

a grounding buss;

said grounding buss comprising at least one mounting bracket; and at least one exterior ground pin receiving port;

said at least one exterior ground pin receiving port comprising a ground pin contact;

said ground pin contact formed on the mounting bracket;

a hot buss forming two sets of hot blade contacts; and a neutral buss forming four sets of neutral blade contacts;

said grounding buss comprising opposing distal ends, and a center portion;

two mounting brackets, each of said mounting brackets on one each of said distal ends and each having a ground pin contact formed thereon; and two sets of ground pin contacts extending from said center portion.

4. The outlet of claim 3:

said grounding buss further comprising a second mounting bracket;

two interior ground pin receiving ports; and a second exterior ground pin receiving port;

said second exterior ground pin receiving port comprising a second ground pin contact;

said second ground pin contact formed on the second mounting bracket.

5. An outlet for supplying electric power to one or more plugs, comprising:

a grounding buss;

said grounding buss comprising at least one mounting bracket; and at least one exterior ground pin receiving port;

said at least one exterior ground pin receiving port comprising a ground pin contact;

said ground pin contact formed on the mounting bracket;

at least two reversible plug port groups;

each of said at least two reversible plug port groups comprising one of said at least one exterior ground pin receiving ports;

a hot receiving port; and a set of two neutral receiving ports;

one each of said neutral receiving ports spaced apart to each side of the hot receiving port; and at least one USB port located between the at least two reversible plug port groups.

6. The outlet of claim 5, with plugs with ground pins for insertion into said exterior ground pin receiving port, further comprising:

an exterior outlet body having an exterior thereof; and the at least one exterior ground pin receiving port further comprising an open slot formed in said exterior outlet body and defined by said mounting bracket;

wherein such open slot exposes an inserted ground pin to the exterior of the exterior outlet body.

7. The outlet of claim 5, with plugs with ground pins for insertion into said exterior ground pin receiving port, further comprising:

an exterior outlet body having an exterior thereof;

said mounting bracket being outward of the exterior outlet body; and said grounding buss further comprising an interior ground pin contact opposing said ground pin contact formed on the mounting bracket;

wherein an inserted ground pin contacts said interior ground pin.

8. An outlet for supplying electric power to one or more plugs, comprising:

a grounding buss;

said grounding buss comprising at least one mounting bracket; and at least one exterior ground pin receiving port;

said at least one exterior ground pin receiving port comprising a ground pin contact;

said ground pin contact formed on the mounting bracket;

a hot buss forming two sets of hot blade contacts;

a neutral buss forming four sets of neutral blade contacts; and at least two reversible plug port groups;

each of said at least two reversible plug port groups comprising one of said at least one exterior ground pin receiving ports;

a hot receiving port; and a set of two neutral receiving ports.

9. The outlet of claim 8, with plugs with ground pins for insertion into said exterior ground pin receiving port, further comprising:

an exterior outlet body having an exterior thereof; and the at least one exterior ground pin receiving port further comprising an open slot formed in said exterior outlet body and defined by said mounting bracket;

wherein such open slot exposes an inserted ground pin to the exterior of the exterior outlet body.

10. The outlet of claim 8, with plugs with ground pins for insertion into said exterior ground pin receiving port, further comprising:

an exterior outlet body having an exterior thereof;

said mounting bracket being outward of the exterior outlet body; and said grounding buss further comprising an interior ground pin contact opposing said ground pin contact formed on the mounting bracket;

wherein an inserted ground pin contacts said interior ground pin.

11. A method of connecting a plug to an electric power outlet, comprising:

inserting a plug having a ground pin into an outlet;

said outlet comprising at least one exterior ground pin receiving port comprising a ground pin contact; and a grounding buss comprising at least one mounting bracket; and said inserting step comprising contacting said ground pin to said ground pin contact formed on the mounting bracket;

said inserting step further comprising completing a circuit by inserting a hot blade into a hot receiving port; and inserting a neutral blade into one of a set of two neutral receiving ports;

one each of said neutral receiving ports spaced apart to each side of the hot receiving port.

12. The method of claim 11, said inserting step further comprising placing said ground pin in an open slot formed in an exterior outlet body of said outlet and defined by said mounting bracket; and said placing step comprising exposing said ground pin to an exterior of the exterior outlet body.

13. A method of connecting a plug to an electric power outlet, comprising:

inserting a plug having a ground pin into an outlet;

said outlet comprising at least one exterior ground pin receiving port comprising a ground pin contact; and a grounding buss comprising at least one mounting bracket; and said inserting step comprising contacting said ground pin to said ground pin contact formed on the mounting bracket; and completing a circuit by connecting said plug to a hot buss forming two sets of hot blade contacts; and a neutral buss forming four sets of neutral blade contacts.

14. The method of claim 13, said inserting step further comprising placing said ground pin in an open slot formed in an exterior outlet body of said outlet and defined by said mounting bracket; and said placing step comprising exposing said ground pin to an exterior of the exterior outlet body.

15. The method of claim 13, said grounding buss further comprising an interior ground pin contact opposing said ground pin contact formed on the mounting bracket;

said inserting step further comprising contacting said ground pin to said interior ground pin contact opposing said ground pin contact formed on the mounting bracket.

16. The method of claim 13, said inserting step further comprising inserting a hot blade into a hot receiving port; and inserting a neutral blade into one of a set of two neutral receiving ports;

one each of said neutral receiving ports spaced apart to each side of the hot receiving port.

17. The method of claim 13, further comprising:

grounding the plug by connecting said plug to said grounding buss.

* * * * *